US009953629B2

(12) United States Patent
Zalisk et al.

(10) Patent No.: US 9,953,629 B2
(45) Date of Patent: Apr. 24, 2018

(54) FLEXIBLE WAVEGUIDE BAND

(71) Applicant: BOSE CORPORATION, Framingham, MA (US)

(72) Inventors: Michael Andrew Zalisk, Arlington, MA (US); Daniel Winchell Tellier, Pepperell, MA (US); Daniel Patrick Baker, Warwick, RI (US); Richard Arthur Grebe, Stow, MA (US)

(73) Assignee: BOSE CORPORATION, Framingham, MA (US)

( * ) Notice: Subject to any disclaimer, the term of this patent is extended or adjusted under 35 U.S.C. 154(b) by 135 days.

(21) Appl. No.: 15/041,957

(22) Filed: Feb. 11, 2016

(65) Prior Publication Data

US 2017/0236508 A1 Aug. 17, 2017

(51) Int. Cl.

| | |
|---|---|
| ***H04R 9/06*** | (2006.01) |
| ***G10K 11/22*** | (2006.01) |
| ***H04R 1/40*** | (2006.01) |

(52) U.S. Cl.

CPC ..... *G10K 11/22* (2013.01); *H04R 1/403* (2013.01)

(58) Field of Classification Search

CPC ..... H04R 1/345; H04R 1/403; H04R 1/1016; H04R 1/2857; H04R 5/023; G10K 11/22

See application file for complete search history.

(56) References Cited

U.S. PATENT DOCUMENTS

| | | | | |
|---|---|---|---|---|
| 3,374,856 | A | 3/1968 | Wirt | |
| 5,203,319 | A | 4/1993 | Danna et al. | |
| 8,818,013 | B2 * | 8/2014 | Tse | H04R 5/023 381/334 |
| 2008/0316864 | A1 * | 12/2008 | Klein | H04R 1/34 367/138 |
| 2016/0021449 | A1 | 1/2016 | Litovsky et al. | |
| 2016/0323665 | A1 * | 11/2016 | Wickstrom | H04R 1/1075 |

FOREIGN PATENT DOCUMENTS

DE 2741049 A1 3/1979

OTHER PUBLICATIONS

International Search Report and Written Opinion for application No. PCT/US2017/017039 dated May 11, 2017.

* cited by examiner

*Primary Examiner* — Brian Ensey
(74) *Attorney, Agent, or Firm* — Lando & Anastasi, LLP

(57) ABSTRACT

A flexible waveguide band is provided for that may be worn by a user around their neck, for example. The flexible waveguide band includes a spine, such as a pliable rod; a plurality of vertebrae mounted on the spine, with each vertebra including at least one waveguide channel guide; and an encapsulating potting material. The flexible waveguide band may also be attached to an acoustic pod, including an acoustic driver that may radiate sound waves into said waveguide channels and exit via a sound outlet opening in the flexible band.

20 Claims, 18 Drawing Sheets

FLEXIBLE WAVEGUIDE BAND

FIELD

This disclosure relates to a wearable acoustic device that may be adjusted to the preferred shape of a user.

BACKGROUND

Wearable personal audio devices can produce sound proximate the ear of the wearer, such as on the shoulders or around the neck of the user. Examples of wearable personal audio devices are disclosed in U.S. patent application Ser. No. 14/799,265, the disclosures of which are incorporated herein by reference, and which describes an acoustic device that is designed to be worn around the neck and is generally "horseshoe"-like or "U"-shaped with waveguides within the housing, each one having an exit below an ear, close to an acoustic driver.

One potential drawback of wearable personal audio devices is that they may be somewhat inflexible and unable to be adjusted to the shape or preference of the user. Thus, there exists a need for a flexible, adjustable audio device that may be worn by a user and adjusted to meet the user's preference.

SUMMARY

This disclosure relates to systems, methods, and apparatuses for providing a flexible, adjustable audio device.

All examples and features mentioned below can be combined in any technically possible way.

In some examples, a flexible waveguide band may be provided for, comprising a spine, a plurality of vertebrae, comprising at least one waveguide channel; attached to the spine, wherein at least a portion of the spine and said plurality of vertebrae are encased within a potting material. In some examples, the spine may be a metal rod or wire and electrical wiring may be wrapped around it. In other examples the flexible waveguide band may also include at least one end cap attached to the spine proximate an end of the spine. In other examples, the plurality of vertebrae may further comprise at least one waveguide channel guide surrounding the at least one waveguide channel. In some examples, the vertebrae may each have two waveguide channel guides that surround two of waveguide channels. The flexible waveguide band may also have two acoustic pods disposed proximate opposite ends of the band. The two acoustic pods may each comprise at least one acoustic driver, and that radiate sound waves into the waveguide channels. In some implementations the flexible waveguide band may be intended for use as a neckband that may be formed into a generally semi-circular shape. In some implementations the flexible band, which may be a neckband, may be adjusted by a user through bending and the flexible waveguide band will substantially retain the adjusted shape. In some examples, the plurality of vertebrae may also include a spacer for adequately spacing one vertebra to another. The acoustic pods may also include a ramped projection for coupling with the end cap. In other examples, the waveguide channels may include projections for receiving at least two removable waveguide cores. Other projections on the exterior of the vertebrae may be used to properly space the vertebrae within the potting material.

Methods of assembling a flexible waveguide band may also be provided for. Such methods may include attaching a plurality of vertebrae, each with at least one waveguide channel guide, along the length of a spine, inserting at least one waveguide core within the waveguide channel guides, and molding the spine, vertebrae, and waveguide core in a potting material before removing the at least one waveguide core from the waveguide channel. In some examples, methods may also include a plurality of vertebrae having two waveguide channel guides and wherein two waveguide channels are defined within the waveguide channel guides by the removal of the at least one waveguide core. In other examples, methods may include disposing the spine, the plurality of vertebrae, and the at least one waveguide core in a semi-circular mold and injecting the material into the mold. Methods may also include attaching at least two end caps proximate the ends of the spine and attaching acoustic pods to said the caps.

In other examples, a flexible dual-waveguide band may be provided, including a spine comprising a pliable rod; a plurality of vertebrae, each having two waveguide channel guides and a center portion, attached to the spine, wherein the center portion comprises an open portion for receiving the spine; two end caps attached to the spine at opposite ends of the spine, wherein the end caps comprise two waveguide channel guides, a center portion, and an electronics opening, and wherein the center portion comprises an open portion for receiving said spine; and potting material encasing the spine, the plurality of vertebrae, and the end caps.

BRIEF DESCRIPTION OF THE DRAWINGS

Various aspects of at least one implementation of a flexible waveguide band are discussed below with reference to the accompanying figures. The figures are provided for the purposes of illustration and explanation and are not intended as a definition of the limits of the disclosure.

DETAILED DESCRIPTION

It should be understood that the following descriptions are not intended to limit the disclosure to an exemplary implementation. To the contrary, it is intended to cover alternatives, modifications, and equivalents as may be included within the spirit and scope of the described subject matter.

Figure 1:
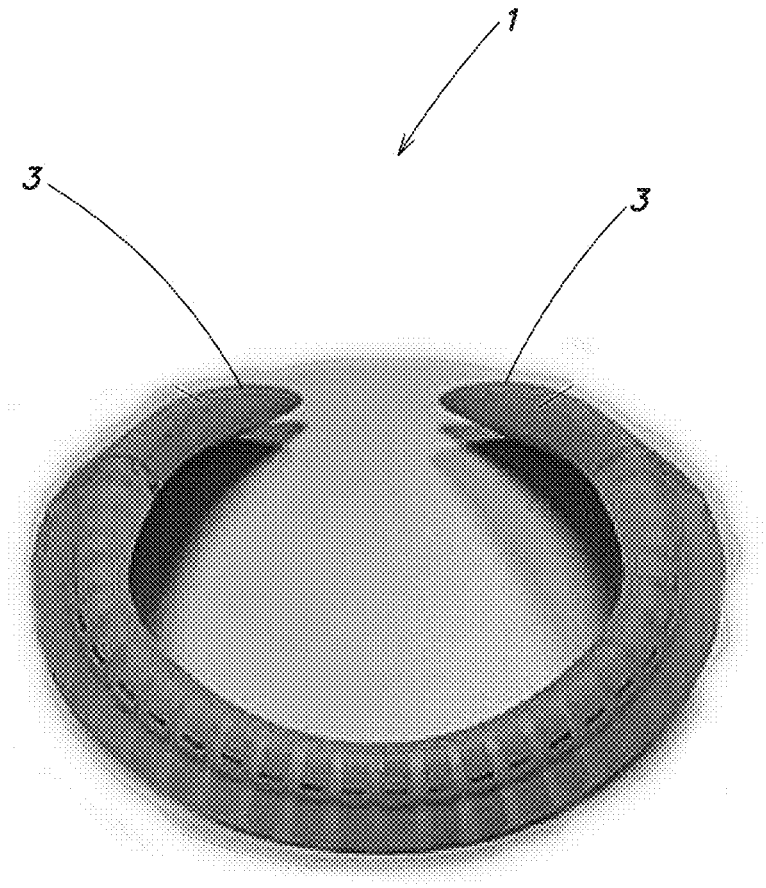
FIG. 1 is a top perspective view of the exterior of a flexible waveguide band according to one implementation of this disclosure.

FIG. 1 is a top perspective view of the exterior of a flexible waveguide band according to one implementation of this disclosure attached to two acoustic pods at opposite ends of the flexible waveguide band. As shown, in this implementation, the flexible waveguide band comprises a curved, flexible band 1 that may naturally conform to a horse-collar or U-shaped neckband. In this implementation, the band is intended to rest around the neck or on the shoulders of the user, and thus a U-shaped or horse-collar shape is a natural starting position for the flexible band. However, the band is intended to be adjustable and may be expanded, straightened, or re-shaped in a manner more suitable to the shape and size of the user or for the user's comfort. The band may be re-configurable such that it retains the desired shape of the user. In other implementations, the initial shape of the flexible band 1 may be more circular, for example, in the case of a belt band. Flexible band 1 may also be shaped so as to easily fit in or around a collar of a shirt or jacket or similar garment or to fit around the rim of a helmet or hat. Other initial shapes for flexible band 1 may be used in order to provide for a wearable personal audio device for various parts of the wearer, as will be appreciated by one of ordinary skill in the art.

FIG. 1 shows acoustic pods 3 at opposing ends of flexible band 1. Acoustic pods 3 each house one or more acoustic drivers and sound outlet openings 32 that produce sound (not shown in FIG. 1). The one or more acoustic drivers may be coupled to a sound outlet opening on the opposing end of flexible band 1 via one or more waveguide structures, as described in previously-mentioned U.S. application Ser. No. 14/799,265, the entire contents of which are incorporated herein by reference. As one of ordinary skill in the art will appreciate, a waveguide acoustic device may include one or more hollow channels for sound propagation, whereby acoustic drivers produce sound waves that travel through the channel. The hollow channel may be referred to as a waveguide. In the example where a flexible waveguide band is being used in a flexible dual-waveguide neckband with two acoustic drivers, the acoustic drivers (not shown in FIG. 1) in acoustic pods 3 may be pointed generally at the expected location of a user's ears via the waveguides. Each waveguide may have one end with its corresponding acoustic driver located in acoustic pod 3 at one side of the head and in proximity to and below the adjacent ear, while the opposite end of flexible band 1 includes a sound outlet opening 32, located at the other side of the head and in proximity to and below the other, adjacent ear. In other implementations, sound outlet opening 32 may be disposed within an acoustic pod 3 at an opposite end of flexible band 1.

Figure 2:
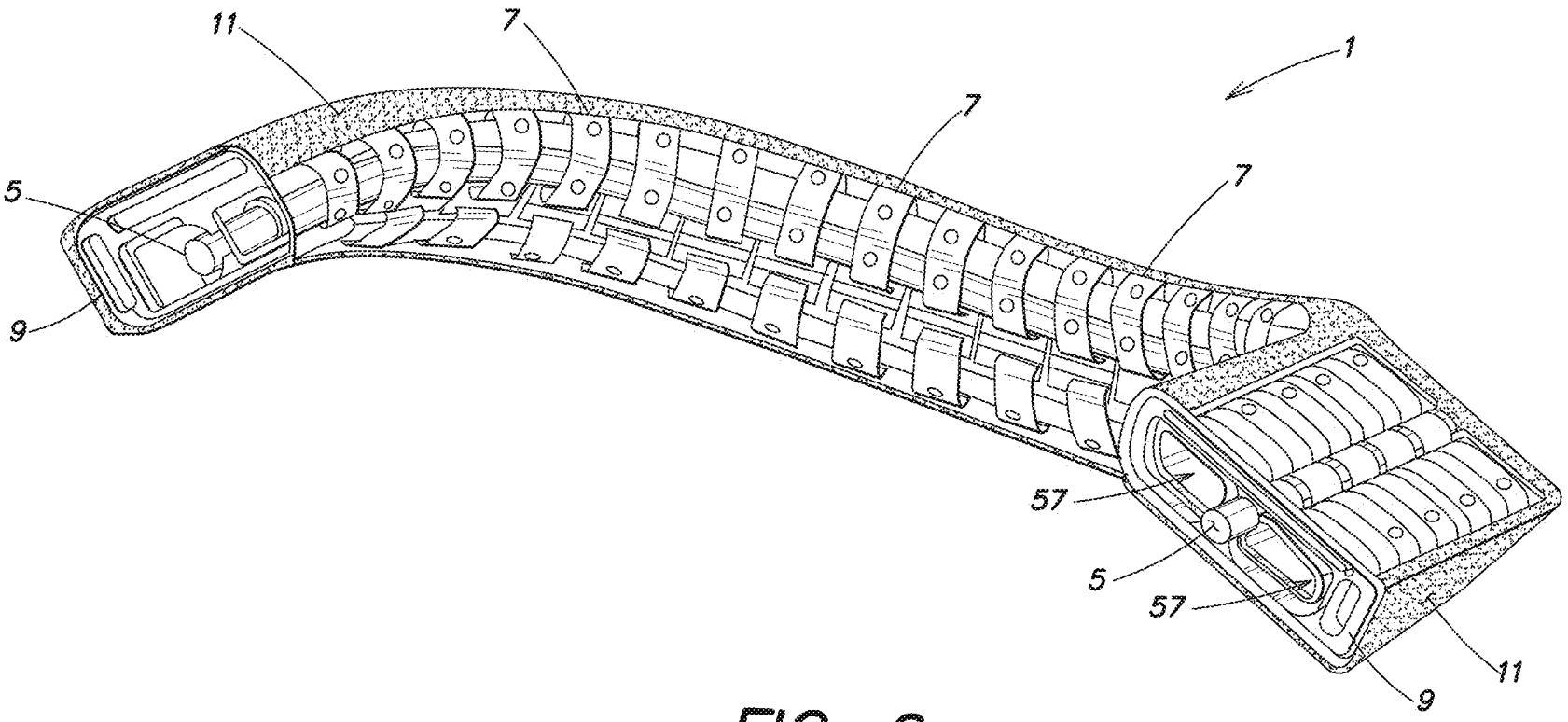
FIG. 2 is a front perspective transparent view of a flexible waveguide band according to one implementation of this disclosure.

FIG. 2 is a front perspective transparent view of a flexible waveguide band according to one implementation of this disclosure. As shown in FIG. 2, the flexible band 1 may include a spine 5, which may be attached to vertebrae 7, and end caps 9, which may all be encased within a potting material 11. Spine 5 may comprise a length or rod of any suitably pliable material, which may be bent or re-shaped in order to accept and retain an overall shape, such as a steel, copper, brass, or aluminum cable or thin rod. Spine 5 may be flexible enough to allow for easy re-configuration and re-shaping by a user, while rigid enough to retain a new user-defined shape.

Vertebrae 7 may comprise one or more rigid pieces that may be connected to spine 5 along the length of spine 5. Any number of vertebrae 7 may be used in order to define a flexible band of sufficient length for a given application. Some implementations may use 25 vertebrae, for example, in a dual-waveguide neckband. Fewer vertebrae 7 may be used where a waveguide band implementation is intended for children, for example, or for different parts of a user's body. Vertebrae 7 may comprise any material that will retain a defined shape and may offer sufficient protection to a waveguide channel defined, in part, by vertebrae 7. Suitable materials may include, but are not limited to, plastic, ABS plastic, metals, carbon fiber, or wood, among others, as one of ordinary skill in the art will appreciate. In some implementations, vertebrae 7 may include a generally hollow center portion through which spine 5 may extend, and two waveguide openings, which may define, in part, two waveguide channels 57.

End caps 9 may be disposed at opposite ends of flexible band 1 and may have an overall shape that corresponds to the intended exterior cross-section of a portion of flexible band 1. End caps 9 may be comprised of any material that may serve as a connection point for acoustic pods 3 and also serve to define, in part, a waveguide channel. Suitable materials may include, but are not limited to, plastic, ABS plastic, metals, carbon fiber, or wood, among others, as one of ordinary skill in the art will appreciate. In some implementations, end caps 9 include a generally hollow center portion through which spine 5 may extend and two waveguide openings on opposing sides of the hollow center portion, which may define, in part, two waveguide channels 57. End caps 9 may also include an opening through which wiring for controlling and powering acoustic pods 3 may extend, as well as an opening to a locking mechanism for connecting pods 3 to end caps 9, in some implementations.

Once assembled, the components of a flexible waveguide band may be encased within a potting material 11, through an injection molding process, for example, using a mold having a desired initial shape for flexible band 1. Potting material 11 may fix the initial position of the various components with respect to one another, define a flexible waveguide channel, and/or provide an exterior surface for the device. Potting material 11 may include any non-conductive, flexible material, such as an elastomer/rubber (e.g., silicone), thermoplastic polyurethane (TPU), or epoxy. Potting material 11 may be sufficiently flexible to bend to the desired shape of the user. In some applications, the potting material 11 may be elastic such that it may return to its original shape, such as for storing flexible band 1. In other examples, potting material 11 may not be elastic, such that flexible band 1 may be wrapped around a surface tightly so as to grip the surface. Potting compound 11 may be sufficiently flexible so as to allow spine 5 to hold flexible band 1 in a user-defined shape without returning to its originally-molded shape.

Figure 3:
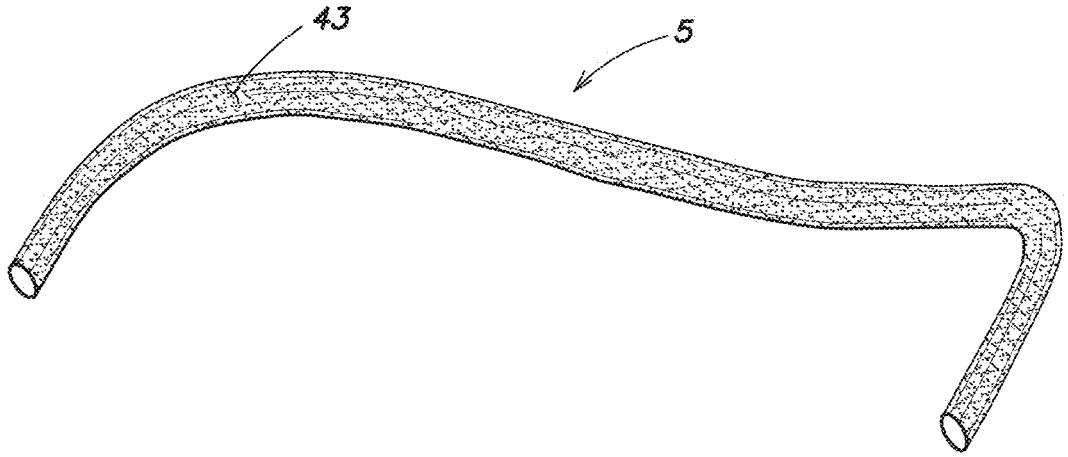
FIG. 3 is a front perspective view of a spine comprising part of a flexible waveguide band according to one implementation of this disclosure.

FIG. 3 is a front perspective view of spine 5. Spine 5 may be bent and/or shaped into the desired initial configuration or shape of flexible waveguide band 1. In some examples, wires may be extended along the length of spine 5 so as to provide power to and control the drivers disposed within acoustic pods 3 (as discussed further below with reference to FIG. 9). In some implementations, wiring may be wrapped around spine 5 in a "candy-cane" fashion in order to avoid breaking wires when flexible band 1 bends or flexes, thereby extending the wiring if it is disposed in a straight line along the length of spine 5. Once wrapped with wiring, spine 5 may optionally be enclosed within an exterior wrapping 43 of encapsulating material, such as a silicone, epoxy, polyester, urethane, or any other suitable encapsulating materials known to one of ordinary skill in the art. Alternatively, spine 5 may be encapsulated with heat-shrink tubing or wrapped with tape, such as electrical tape or heat-shrink tape, in order to further secure the wiring to spine 5.

Figure 4B:
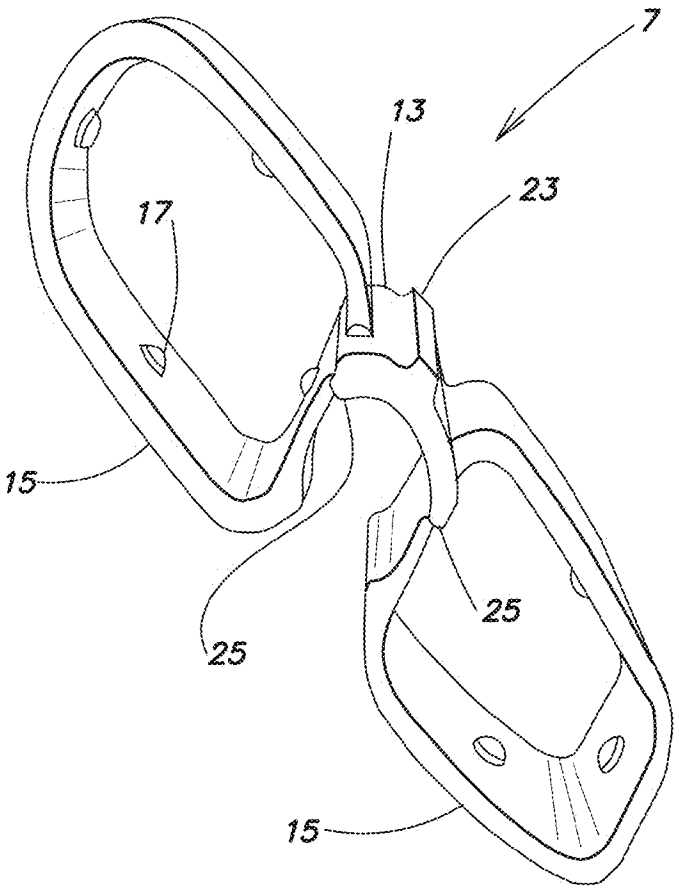
FIG. 4B is a front upper perspective view of a vertebra comprising part of a flexible waveguide band according to one implementation of this disclosure.
Figure 4A:
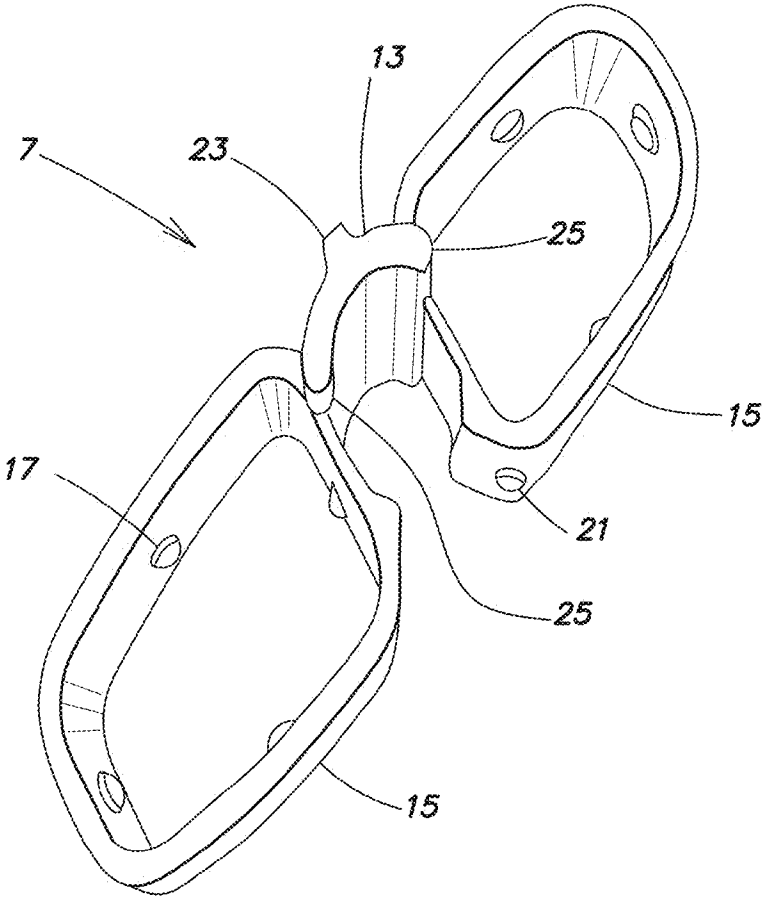
FIG. 4A is a rear lower perspective view of a vertebra comprising part of a flexible waveguide band according to one implementation of this disclosure.
Figure 5A:
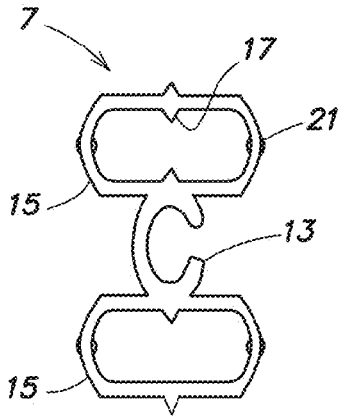
FIG. 5A is a cross-sectional view of a vertebra in a vertical orientation.
Figure 5B:
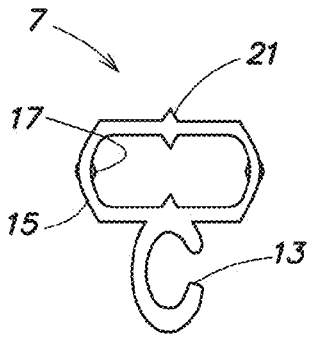
FIG. 5B is a cross-sectional view of a vertebra with a single channel guide.
Figure 5C:
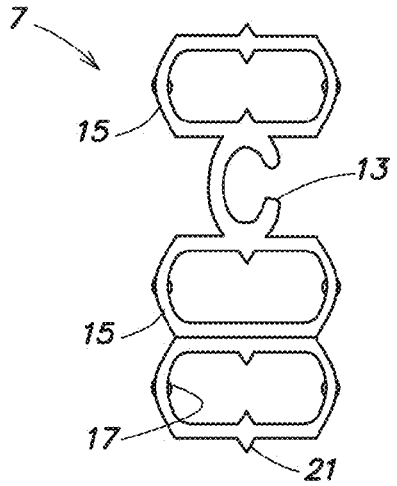
FIG. 5C is a cross-sectional view of a vertebra with three channel guides.
Figure 5D:
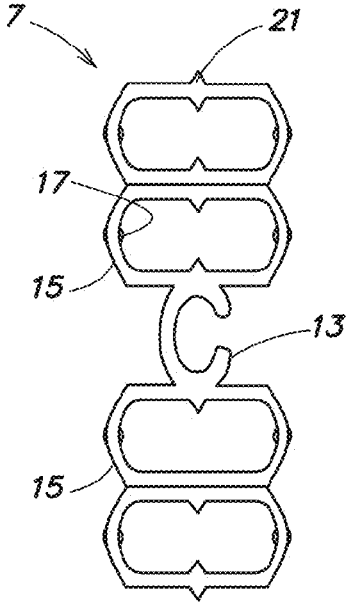
FIG. 5D is a cross-sectional view of a vertebra with four channel guides.
Figure 5E:
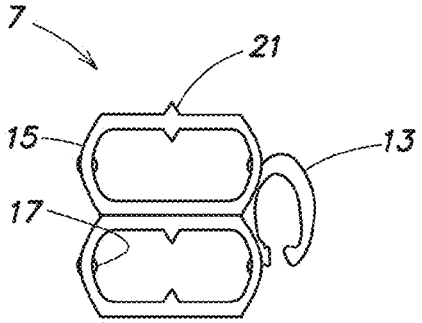
FIG. 5E is a cross-sectional view of a vertebra with an off-center open portion.

FIGS. 4A and 4B show examples of vertebra 7. FIG. 4A is a rear lower perspective view of an exemplary vertebra 7. FIG. 4B is a front upper perspective view of an exemplary vertebra 7. Vertebrae 7 may include a center portion 13 for receiving spine 5 between two channel guides 15. Center portion 13 connects channel guides 15 and may include a portion for receiving and attaching to spine 5 using any suitable means for attachment known to one of ordinary skill in the art. In some implementations, center portion 13 may include a bore through which spine 5 may be inserted, as shown for example, in FIGS. 4A and 4B. Alternatively, center portion 13 may include a clip or other suitable fastener for attaching to spine 5. In some implementations, channel guides 15 comprise one or more loops that may be formed integrally with vertebrae 7 which, in combination with potting material 11, define a hollow waveguide channel 57 through their center. Channel guides 15 may be sized and dimensioned in order to meet the acoustic needs of the device and as necessary to define a desired waveguide channel configuration. Channel guides 15 may also be shaped as needed to achieve the desired exterior shape and size of flexible band 1. For example, as depicted in FIGS. 4A and 4B, a right channel guide may comprise an irregular rectangle, whereas the left channel guide may comprise an irregular rectangle with a rounded side. However, one of ordinary skill in the art will appreciate that a channel guide may take any suitable shape, depending on the desired design. In some implementations, the cross section of the channel guides may vary along the length of the flexible band 1 to accommodate the changing size and/or shape of flexible band 1 along various points of the band. In some implementations, the cross-sectional area of the hollow area defined by channel guide 15 may be about 50 $mm^2$, although one of ordinary skill in the art will appreciate that a wide range of sizes may be implemented, based on the structural and acoustic needs of the device. In other implementations, the cross-sectional of the hollow area defined by channel guide 15 may be about 25-100 $mm^2$.

As shown, for example, in FIGS. 5A-5E, the shape, size, orientation, and number of channel guides 15 in vertebrae 7 may vary depending on the acoustic needs of the device. For example, in some implementations, channel guides 15 may be stacked in a vertical orientation as shown, for example, in FIG. 5A, whereas in other implementations they may be disposed horizontally as shown, for example, in FIGS. 4A-4B. In other examples, one, three, four or any necessary number of channel guides 15 may be oriented proximate to center portion 13 as shown, for example, in FIGS. 5B-5D. A different number of channel guides 15 may be needed, for example, to accommodate a different number of acoustic drivers and/or waveguide structures, depending on the structural and acoustic needs of the device. In other examples, the open portion 13 for receiving spine 5 may be off-center and may be located on any part of vertebra 7 as shown, for example, in FIG. 5E.

Figure 7A:
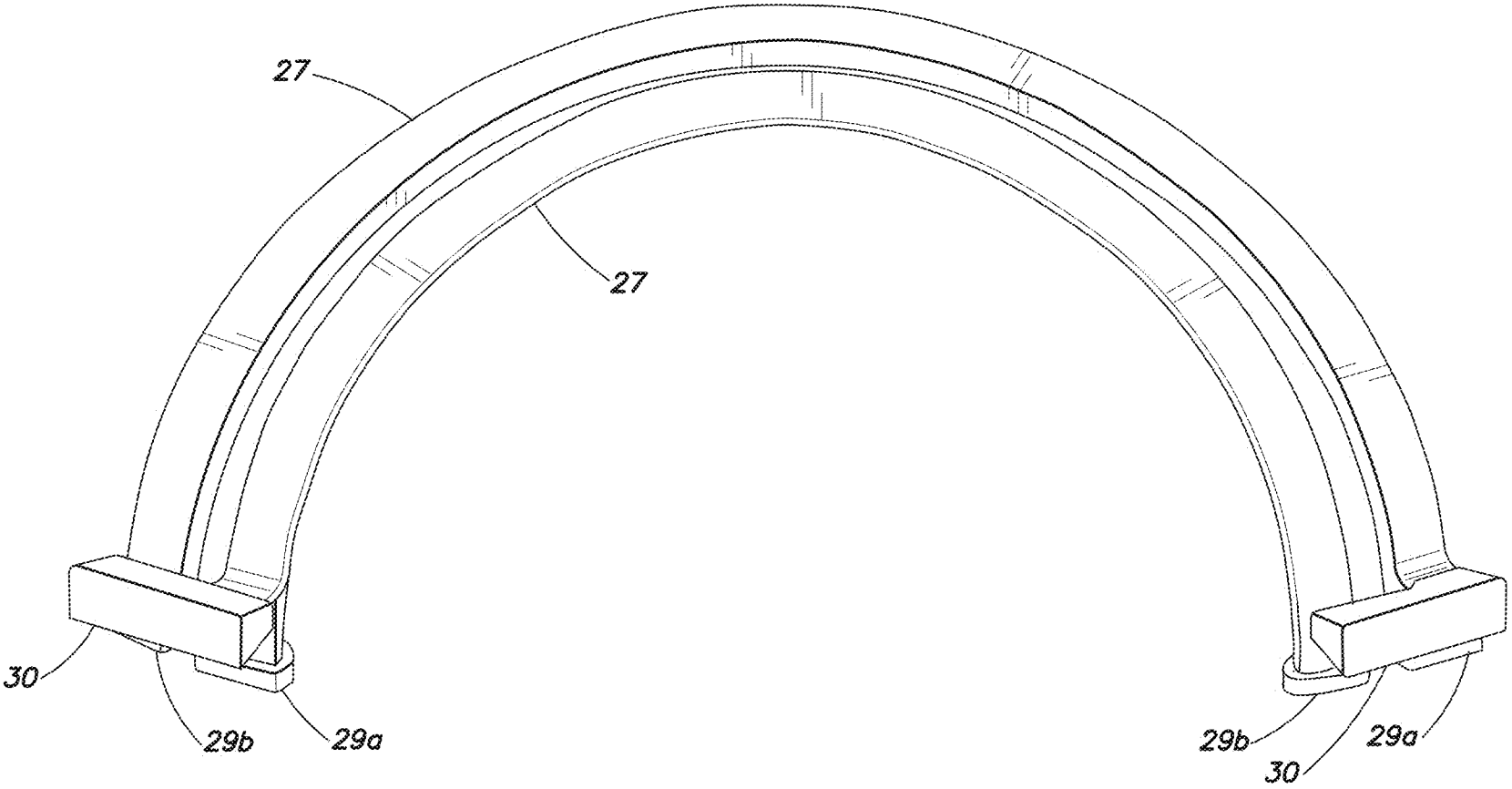
FIG. 7A depicts a top perspective view of waveguide cores for a flexible waveguide band according to one implementation of this disclosure.
Figure 7B:
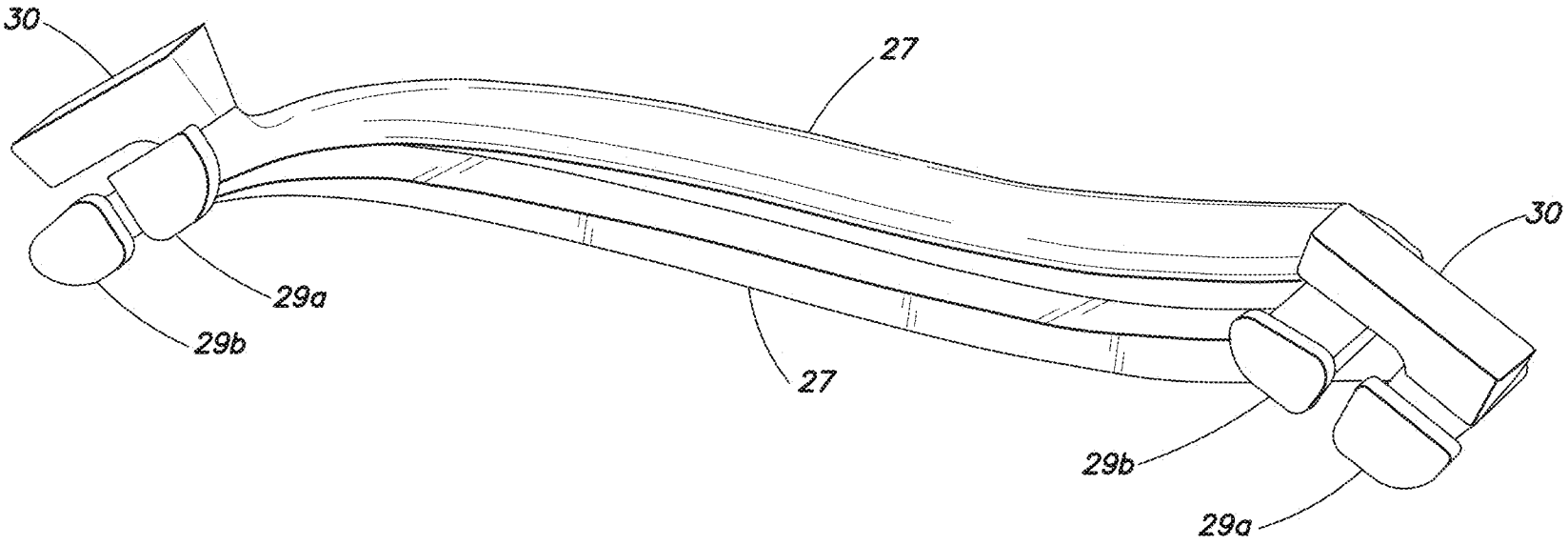
FIG. 7B depicts a front perspective view of waveguide cores for a flexible waveguide band according to one implementation of this disclosure.
Figure 7C:
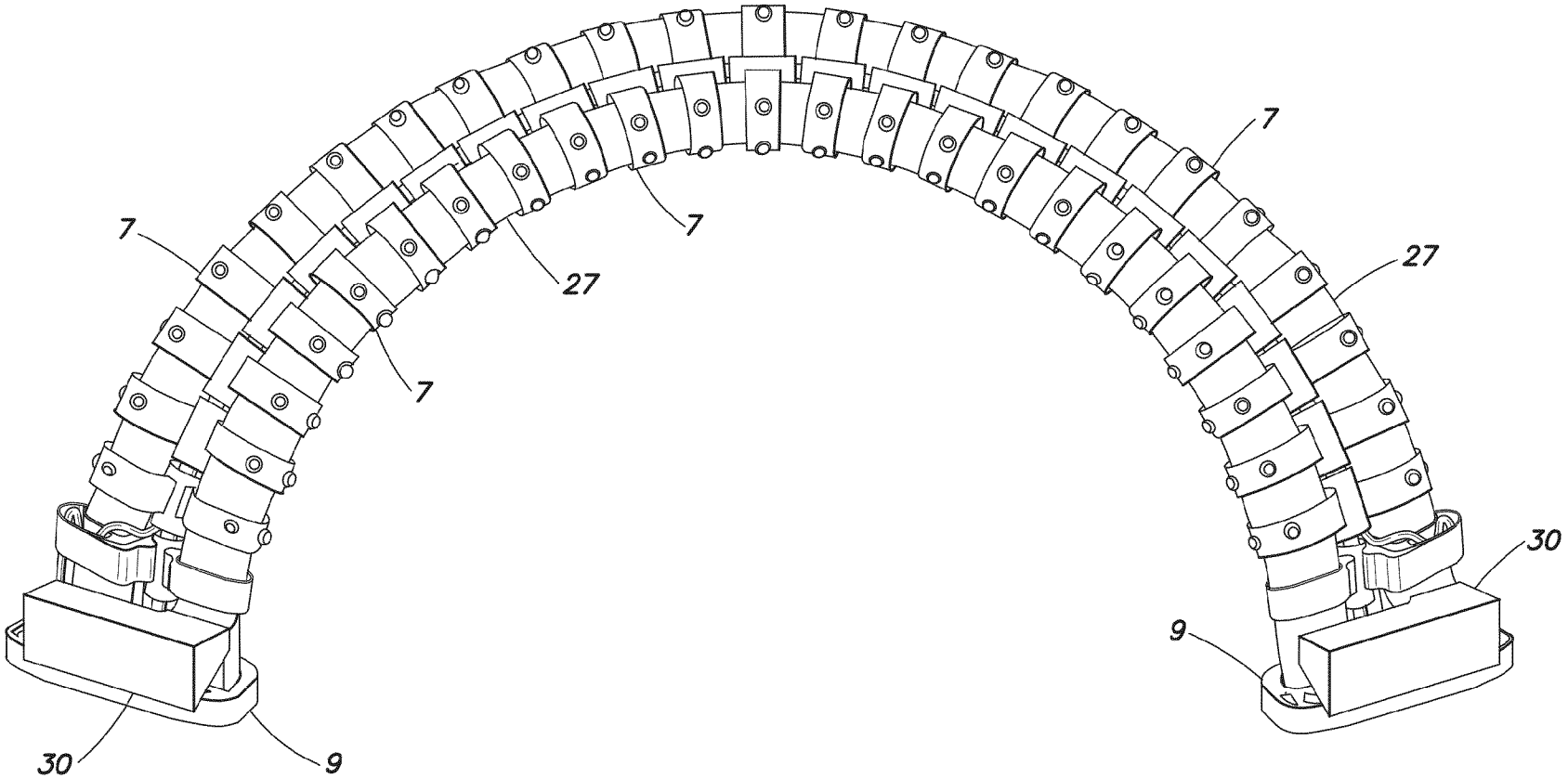
FIG. 7C depicts a top perspective view waveguide cores for a flexible waveguide band after they have been inserted through a series of vertebrae according to one implementation of this disclosure.

Referring again to FIGS. 4A-4B, the channel guides 15 may also include internal projections 17 that allow for proper spacing and orientation of a waveguide core 27 (shown in FIGS. 7A-7C). Internal projections 17 may be placed around the internal perimeter of channel guide 15 and provide for space between the internal perimeter of channel guide 15 and waveguide core 27. This internal space may allow waveguide channel 57 to be substantially formed within potting material 11, and not channel guide 15, itself. Furthermore, internal projections 17 may allow for easier removal of waveguide core 27 by interrupting the contact between potting material 11 and the outer surface of waveguide core 27, thereby reducing overall friction between those two surfaces during the removal of waveguide core 27. Channel guides 15 may also include exterior projections 21. Exterior projections 21 may be placed around the exterior surface of vertebra 7 and may help to maintain proper spacing between the vertebrae 7 and the outer surface of flexible band 1, during the molding process. Center portion 13 may be defined, in part, by a ridge 23 along its top surface, which may also help maintain spacing between the vertebrae 7 and the outer surface of flexible band 1, during the molding process. Vertebrae 7 may also include a spacer portion 25 extending from vertebrae 7 in order to maintain the desired spacing between individual vertebrae as they are attached to spine 5. In some implementations, spacer portion 25 may extend from ridge 23, as shown for example in FIGS. 4A and 4B, or from other portions of vertebra 7. The depth of vertebrae 7 may be sufficient to provide adequate structural support for a waveguide channel, without adversely affecting the flexibility of flexible band 1. In some implementations, vertebrae 7 may be about 5-8 mm in depth, although larger or smaller depths may be desirable depending on the needs of the particular flexible band design.

Figure 6:
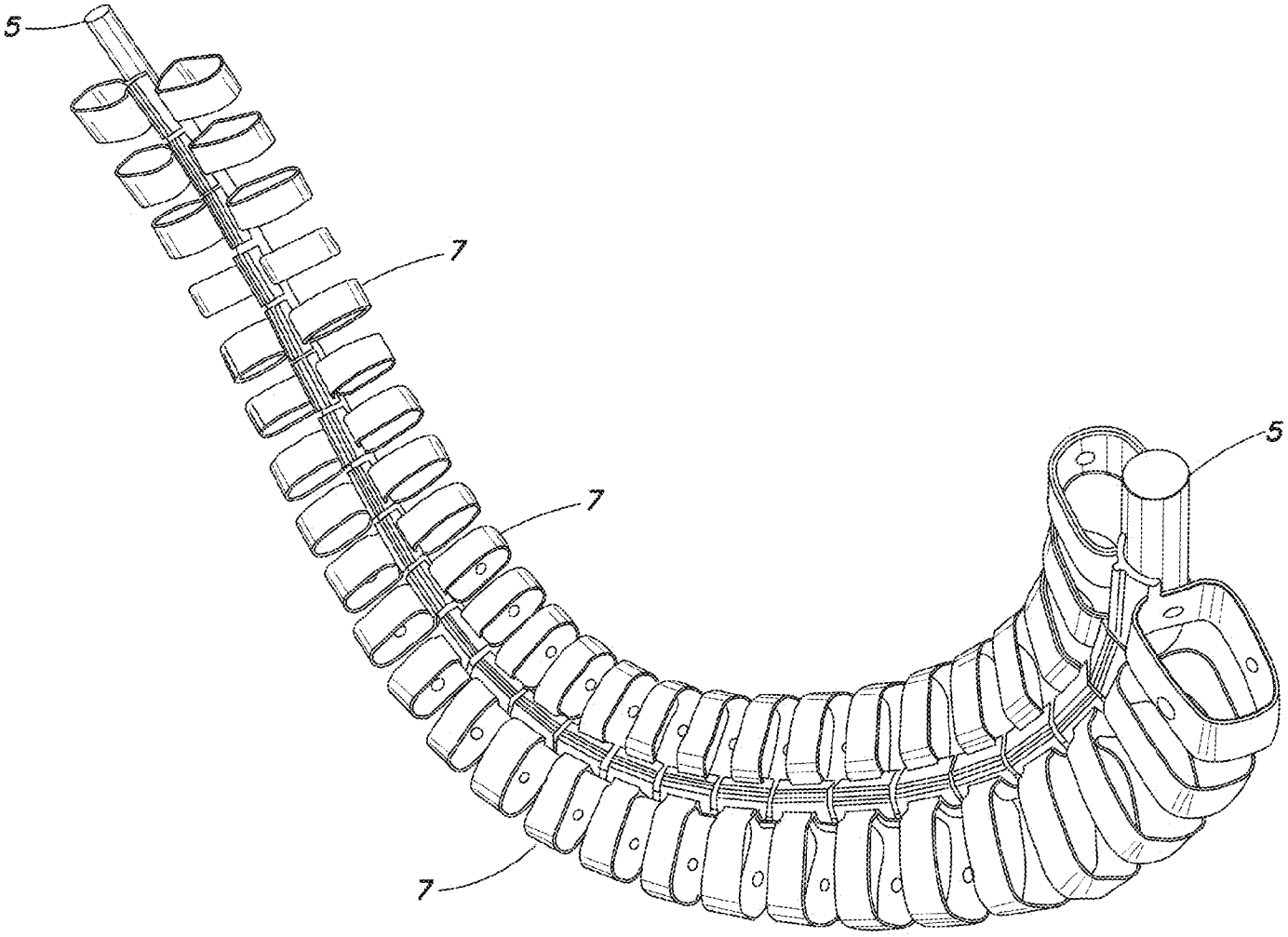
FIG. 6 is a lower right perspective view of a spine assembled with a series of vertebrae comprising part of a flexible waveguide band according to one implementation of this disclosure.

FIG. 6 is a lower right perspective view of spine 5 assembled with a series of vertebrae 7. As shown, vertebrae 7 may be assembled onto spine 5 by placing center portion 13 onto spine 5. The opening in center portion 13 may be sized and dimensioned so as to ensure a friction fit between the internal surface of the opening in center portion 13 and the outer surface of spine 5, such that vertebrae 7 may be "snapped" onto spine 5. However, other means of attachment may also be employed, such as gluing or molding rigid vertebrae 7 directly onto spine 5. In other implementations, center portion 13 could include a closed circle opening and vertebrae 7 may slide through the circle opening onto spine 5. Alternatively, center portion 13 may include a clip or other suitable mechanical fastener for attaching spine 5. The number of vertebrae 7 attached to spine 5 depends on the length of spine 5 and the desired spacing between each vertebra, which can be dictated by the dimensions of spacer portion 25. As shown, about 25 vertebrae may be suitable for use in a flexible dual-waveguide neckband implementation. Fewer vertebrae 7 may be employed in other applications, for example when a waveguide neckband implementation is intended for use by children. Similarly, more vertebrae 7 may be employed in other applications, for example when a waveguide implementation is intended for use on or around a helmet, hat or head.

FIGS. 7A-7C depict waveguide cores 27 for use in manufacturing a flexible waveguide band according to one implementation of this disclosure. Waveguide cores 27 may be inserted through channel guides 15 in order to define waveguide channel 57 (not shown in FIGS. 7A-7C) prior to the molding process. FIG. 7C depicts waveguide cores 27 after they have been inserted through channel guides 15, in one implementation, and prior to being molded within potting material 11. Once flexible band 1 has been molded, such as in a compression or injection molding process, waveguide cores 27 may be removed leaving a hollow waveguide channel 57 through channel guides 15 and potting material 11. Waveguide cores 27 may be formed of any material that may be extracted from a flexible waveguide band after it has been molded including, but not limited to, plastic, ABS plastic, metals, carbon fiber, or wood, among others, as one of ordinary skill in the art will appreciate. Waveguide cores 27 may be reusable. Waveguide cores 27 may also have an overall shape that corresponds to the desired, initial shape of waveguide channel 57. Waveguide cores 27 may have a cross-sectional shape that is sized and dimensioned to meet the acoustic needs of the waveguide, according to the intended uses for the flexible waveguide band 1. In some implementations, the cross section of waveguide cores 27 may vary along their length.

In some implementations, waveguide cores 27 may also comprise a plug 29 at one or more ends that may mate with the openings to the waveguide channel at end caps 9. Plug 29 may prevent potting material 11 from entering the waveguide channel during the molding process. Plug 29 may also be sized and dimensioned so as to mate with the waveguide channel openings in end cap 9. For example, a plug 29*a* may comprise a chamfered rectangle cross-section at an end of waveguide core 27 associated with an incoming end of waveguide channel 57 (e.g. an end that is distal from its associated acoustic driver). A plug 29*b* may comprise an oblong rectangle at an end of waveguide core 27 associated with an outgoing waveguide channel (e.g. a waveguide channel proximal to its associated acoustic driver), as in the implementation shown in FIGS. 7A-7B.

In some implementations, an incoming end of waveguide core 27 may also include one or more top plugs 30 which may be integrally formed with waveguide core 27 or may comprise a separate plug that may be attached to waveguide core 27 after it has been inserted through channel guides 15. Top plug 30 may define a sound outlet opening 32 (not shown in FIGS. 7A-7C) at the top of flexible band 1 prior to the molding process. Once flexible band 1 has been molded, such as in a compression or injection molding process, top plugs 30 may be removed leaving a sound outlet opening 32 through potting material 11 as shown, for example, in FIGS. 11A and 12A. The shape of plugs 29*a* and 29*b*, as well as waveguide core 27 may also aid the proper connection with acoustic pod 3, as discussed further below, with respect to FIGS. 11A-B and 12A-B.

In some examples, waveguide cores 27 may be shaped and arranged so as to provide waveguides through flexible band 1. In some implementations, it may be desirable to allow waveguide cores 27 to cross at some point along the length of flexible band 1. In implementations where waveguide cores 27 remain substantially parallel throughout the length of flexible band 1 the resulting waveguide channels may be of differing lengths because one waveguide may have a shorter distance around the flexible band 1. The resulting difference in lengths between the two resulting waveguide channels may result in waveguides with different acoustic properties. If necessary, the resulting difference in acoustic properties may be overcome by making adjustments to the acoustic drivers associated with each waveguide channel in a manner familiar to one of ordinary skill in the art. Alternatively, waveguide cores 27 may be configured to cross one or more times through the length of flexible band 1, thereby ensuring that the resulting waveguide channels are of substantially similar length and have substantially similar acoustic properties.

Figure 8A:
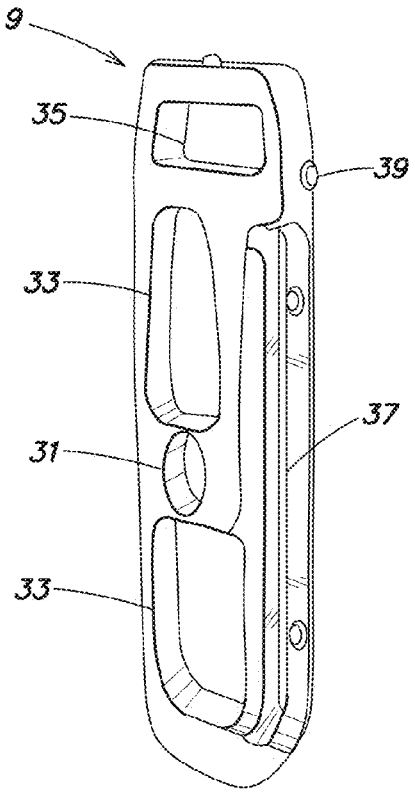
FIG. 8A depicts an interior view of an end cap for a flexible waveguide band according to one implementation of this disclosure.
Figure 8B:
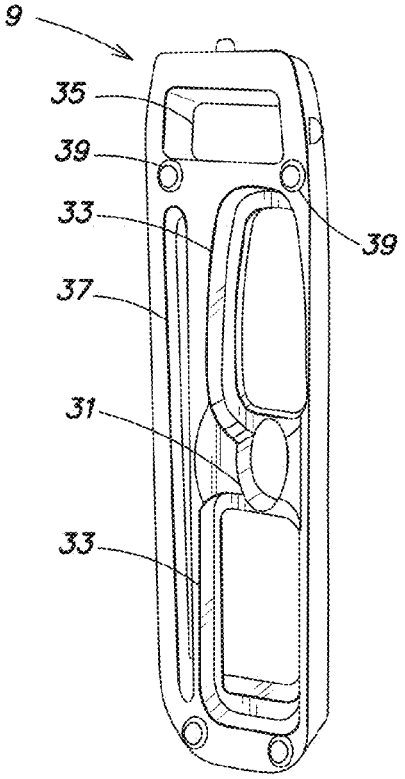
FIG. 8B depicts an exterior view of an end cap for a flexible waveguide band according to one implementation of this disclosure.
Figure 8C:
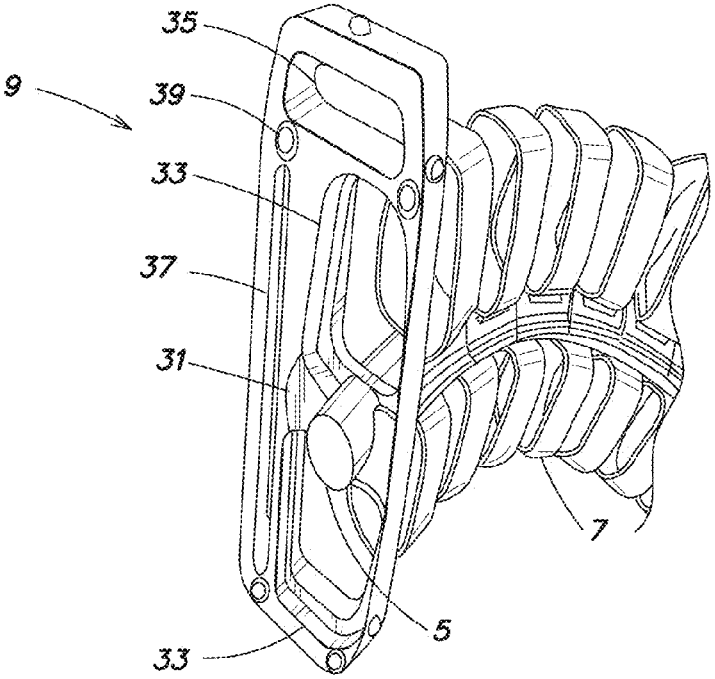
FIG. 8C depicts an end cap assembled on a spine according to one implementation of this disclosure.
Figure 8D:
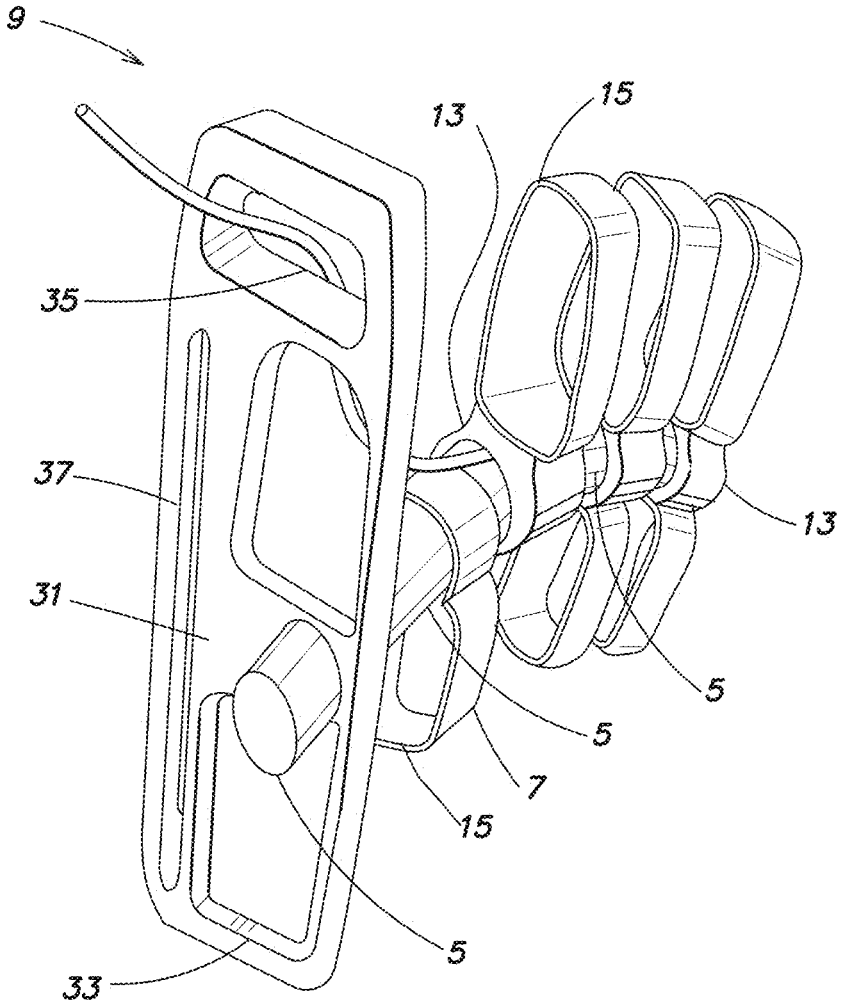
FIG. 8D depicts wiring for a flexible waveguide band being threaded from a vertebra through an end cap in one implementation of this disclosure.
Figure 8E:
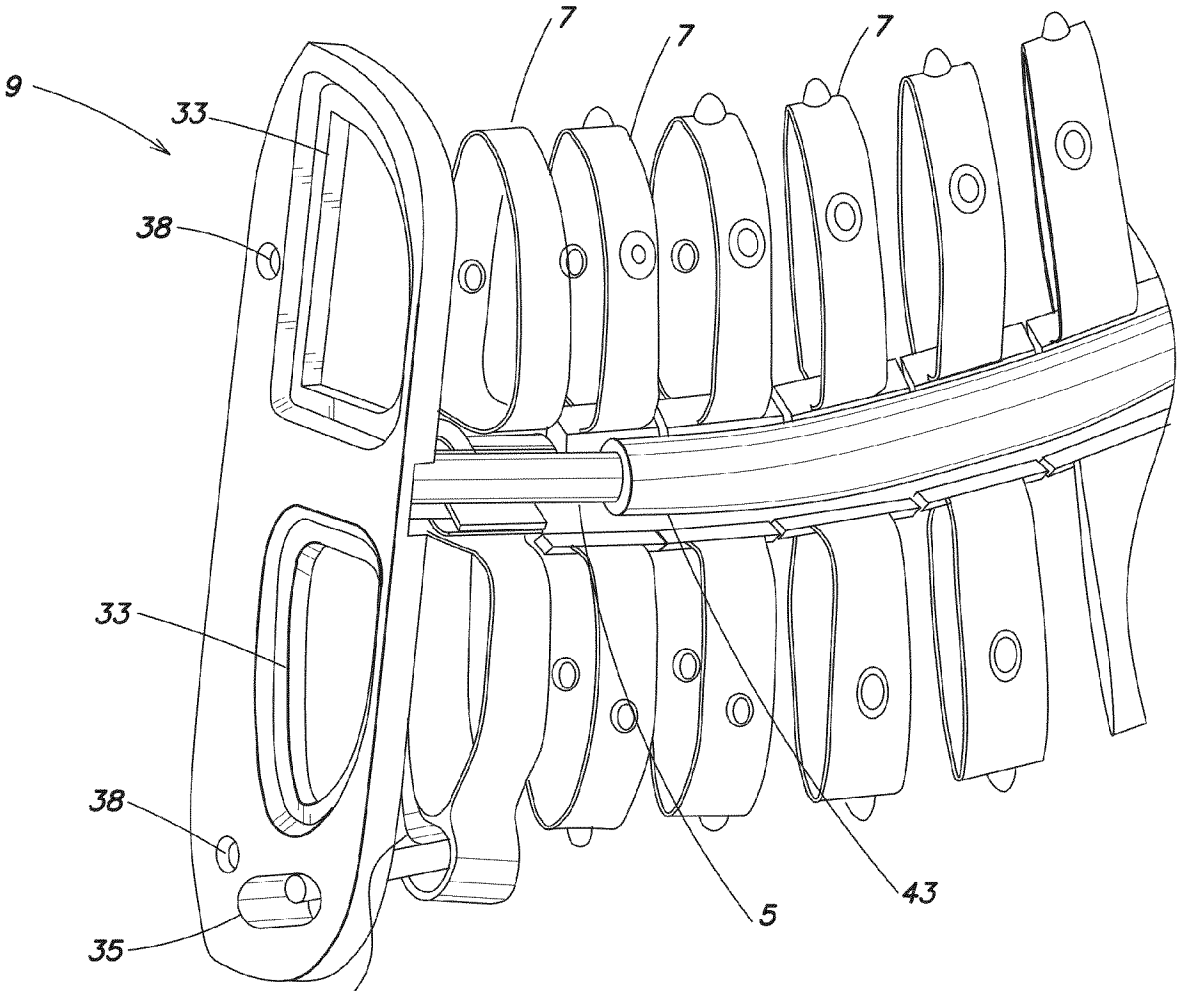
FIG. 8E depicts wiring for a flexible waveguide band being threaded from a vertebra through an end cap in another implementation of this disclosure.
Figure 8F:
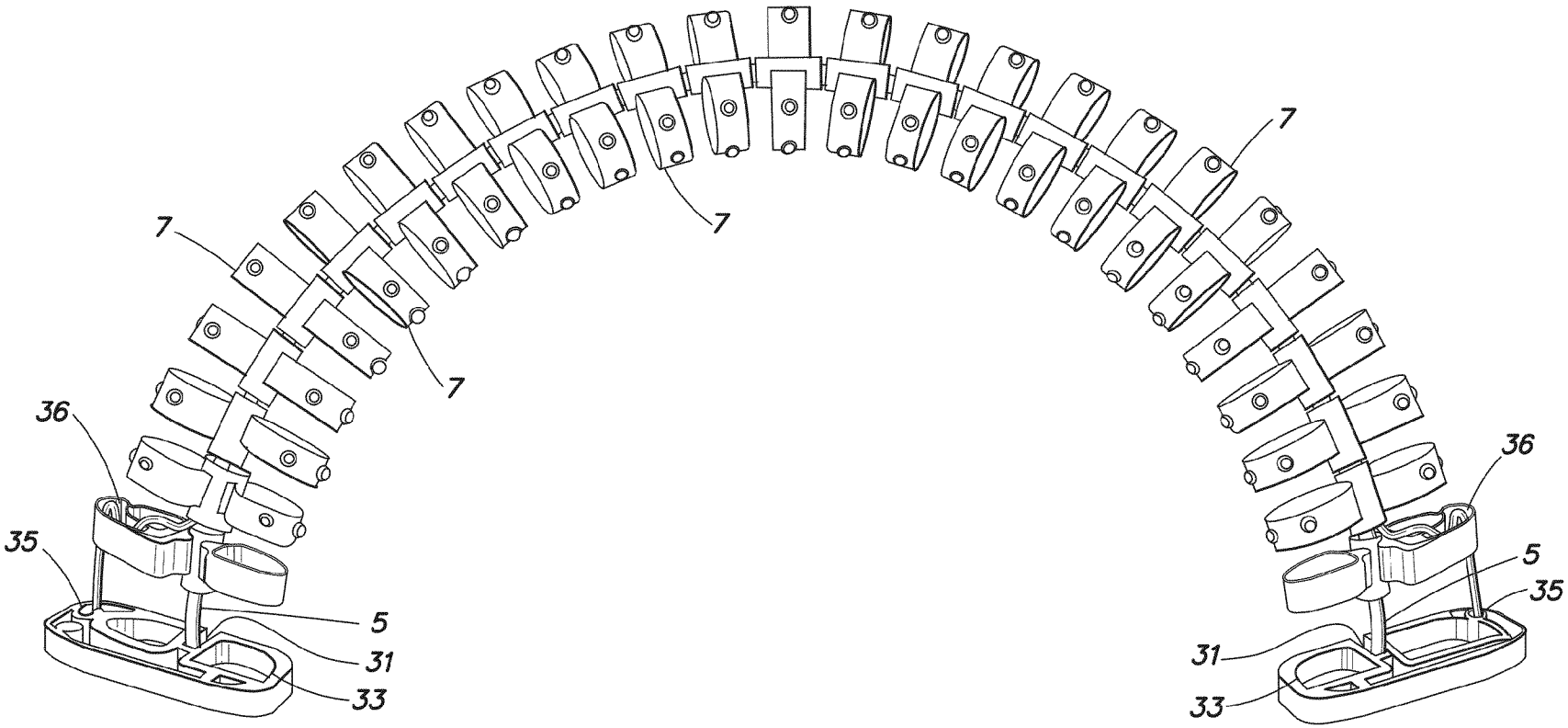
FIG. 8F depicts a top perspective view of wiring for a flexible waveguide band being threaded from a vertebra through an end cap in another implementation of this disclosure.

FIGS. 8A-8C depict an end cap 9 in three orientations. FIG. 8A depicts an interior view of end cap 9. FIG. 8B depicts an exterior view of end cap 9. FIG. 8C depicts an end cap assembled on a spine 5. End cap 9 may include a center portion 31 which may connect and properly space channel guides 33 from one another. Center portion 31 may also include an opening for receiving spine 5. In some implementations, center portion 31 may include a bore through which spine 5 may be inserted, as shown for example, in FIGS. 8A-8D. In other implementations, center portion 31 may comprise a recessed portion on the interior of end cap 9 that does not fully extend through end cap 9 as shown, for example, in FIGS. 8E-8F. Alternatively, center portion 31 may include a clip or other suitable mechanical fastener for attaching to spine 5. Channel guides 33 may be sized and dimensioned similar to channel guides 15 and, in some implementations, may comprise substantially the same interior shape. In examples where the cross section of the channel guides 15 change along the length of the flexible band, channel guides 33 may be sized and dimensioned similar to the channel guide 15 in the last vertebra 7 prior to end cap 9.

End cap 9 may also include an electronics opening 35, which may be sized so as to accommodate wiring for acoustic pods 3. In some implementations it may be necessary to separate the wiring from spine 5 proximate end cap 9 in order to deliver the wiring through electronics opening 35. In some implementations, the wiring may be guided around vertebra 7 and into electronics opening 35 as shown, for example, in FIGS. 8E and 8F. In such implementations, a modified version of vertebrae 7 may also be molded to provide a passageway 36 through which the wiring may be threaded as shown, for example, in FIGS. 8E and 8F. In some implementations, the last vertebra 7 prior to end cap 9 may not include one of the two channel guides 15 in order to provide additional space for the wiring to be guided into electronics opening 35 as shown, for example, in FIG. 8D. In other implementations, it may be possible to drill holes in the vertebrae 7 and thread the wiring through the drilled holes.

In some implementations, end cap 9 may also include a connection slot 37 which may house a locking mechanism that may couple with a locking tab on acoustic pods 3 for further fastening as shown, for example, in FIGS. 8A-8C. In such implementations, connection slot 37 may allow a projection or blade attached to acoustic pods 3 to extend therethrough in order to lock with end cap 9, or otherwise be fastened to flexible waveguide band 1. In some implementations, connection slot 37 may lead to one or more locking mechanisms such as a snap lock or any other locking mechanism familiar to one of ordinary skill in the art. In the alternative, a locking blade attached to acoustic pods 3 may be adhered within connection slot 37 using any suitable adhesive, or may be fastened using a screw, bolt and/or pin, as is known to one of ordinary skill in the art. In other examples, a projection from acoustic pod 3 may form a press fit or friction fit with connection slot 37. Alternatively, end cap 9 may include one or more guide holes 38 for receiving a screw or other fastener to secure acoustic pods 3 to the ends of flexible waveguide band 1 as shown, for example, in FIG. 8E. In such examples, glue or another suitable adhesive may also be applied between end cap 9 and acoustic pod 3 in order to further secure acoustic pods 3 to the ends of flexible waveguide band 1.

In some examples, end cap 9 may also include a plurality of external projections 39 that are sized and arranged around the external surface of end cap 9 so as to provide spacing between the end cap and a form during the molding process. External projections allow for a layer of potting material 11 to encase end cap 9. However, in other implementations, external projections 39 may be removed, to ensure that there is no layer of potting material 11 over end cap 9 as shown, for example, in FIG. 8E.

Figure 9:
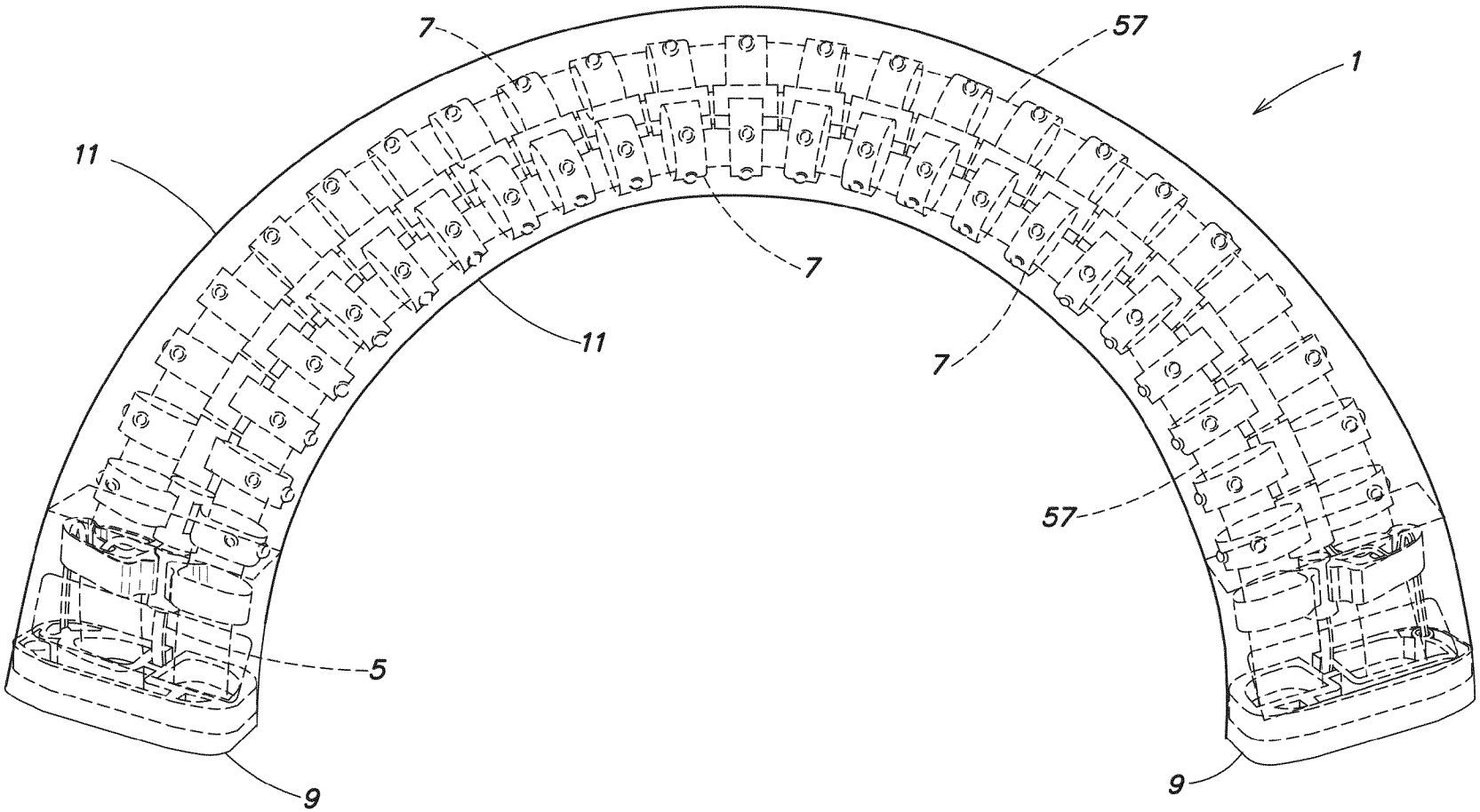
FIG. 9 depicts a flexible waveguide band according to one implementation of this disclosure after it has been encased in a potting material.

FIG. 9 depicts a flexible waveguide band according to one implementation of this disclosure after it has been encased in potting material 11. Potting material 11 may be introduced to a flexible waveguide band through any suitable means known to one of ordinary skill in the art including, but not limited to, injection or compression molding. During the molding process, a flexible waveguide assembly, including a spine 5, vertebrae 7, end caps 9, and waveguide cores 27 may be disposed into a mold having the desired initial shape for flexible waveguide band 1. A suitable potting material 11, such as a silicone, may then be injected or pressed into the mold, thereby encasing the aforementioned components. After the flexible waveguide band 1 is removed from the mold, waveguide cores 27 may be removed, revealing one or more waveguides 57. In some implementations, the flexible waveguide band (either alone or in combination with acoustic pods 3) may be painted and/or covered in fabric material, such as cotton, leather, canvas, silk, or polyester, although one of ordinary skill in the art will appreciate that any suitable material may be used. In other examples, the flexible waveguide band may be further encased within a layer of rubber or plastic.

Figure 10:
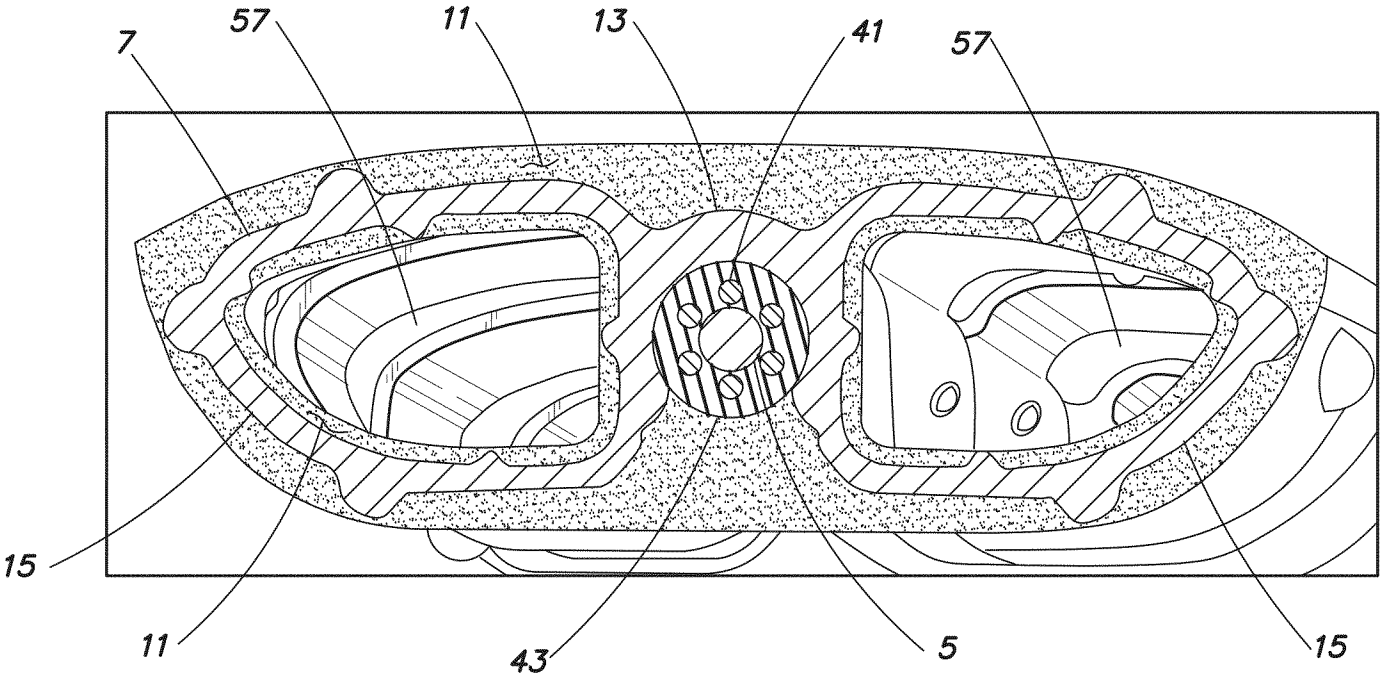
FIG. 10 depicts a cross section of a flexible waveguide band according to one implementation of this disclosure after it has been encased in a potting material.

FIG. 10 depicts a cross section of a flexible waveguide band 1 according to one implementation after it has been encased in potting material 11 and waveguide cores 27 have been removed. As shown in this exemplary implementation, the exterior of the flexible waveguide band is encased in a flexible potting material 11, which may also fill a portion of the waveguide channel 15 (until it reaches the waveguide cores 27) as a result of the injection molding process, thereby defining waveguide channels 57. Vertebrae 7 are disposed within flexible potting material 11. Two channel guides 15 remain after the removal of waveguide cores 27. Spine 5 may be disposed within center portion 13. In this example, wiring 41 is wrapped around spine 5 in a "candy cane" pattern, and an exterior wrapping 43 is wrapped around the wiring and spine 5, thereby encapsulating wires 41 and spine 5.

Figure 11A:
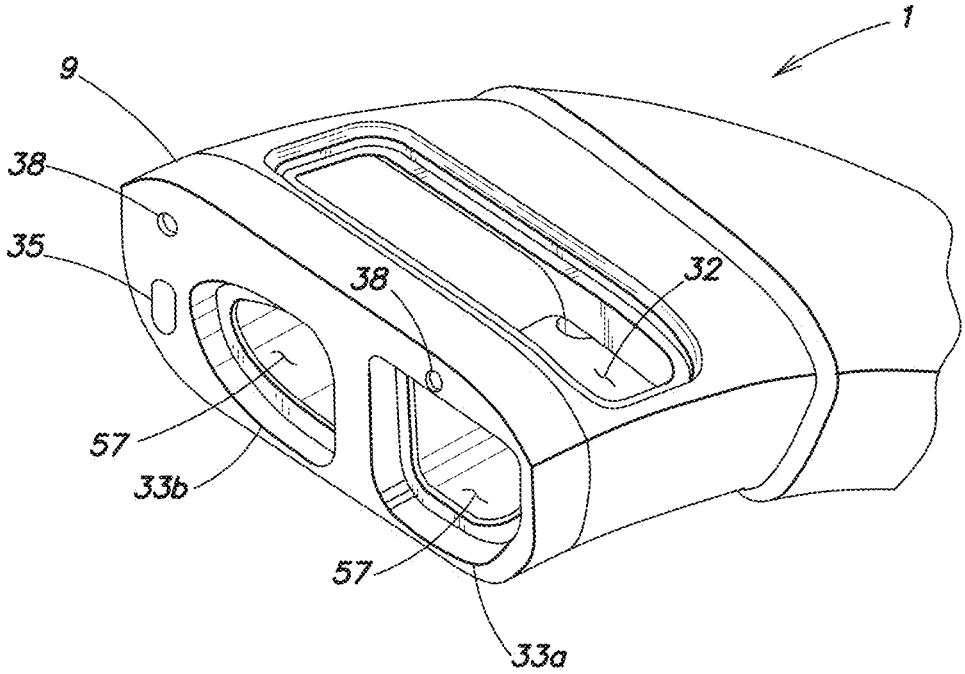
FIG. 11A depicts a perspective view of a connecting end of a flexible waveguide band according to one implementation of this disclosure.
Figure 11B:
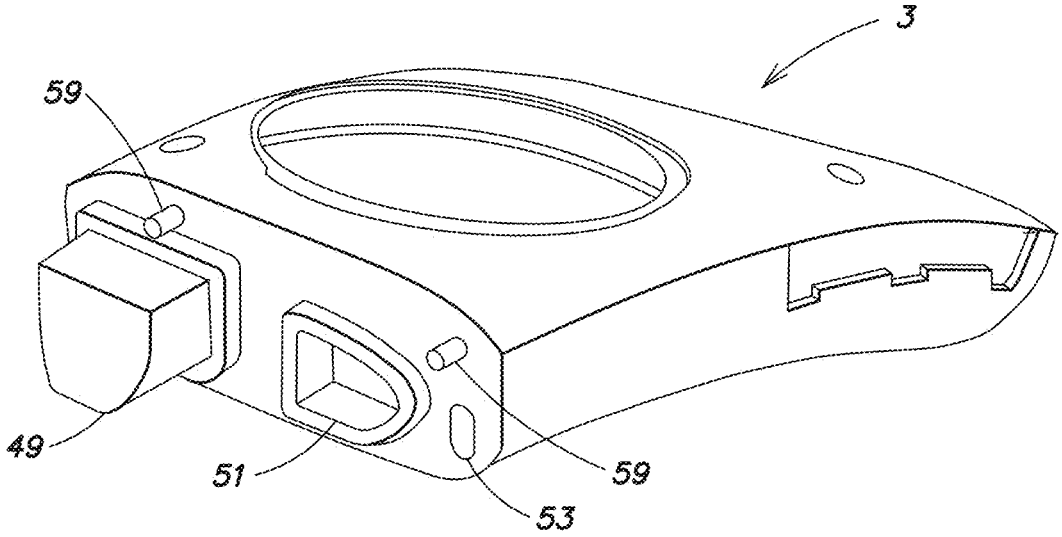
FIG. 11B depicts a perspective view of a connecting end an acoustic pod according to one implementation of this disclosure.

FIGS. 11A and 11B depict perspective views of the connecting ends of a flexible waveguide band 1 and an acoustic pod 3, respectively, according to one implementation of this disclosure. As shown, channel guides 33 on end cap 9 may be sized and dimensioned so as to properly couple flexible band 1 with an acoustic pod 3. For example, a channel guide 33*a* may comprise chamfered rectangle at an incoming end of a waveguide channel 57 (e.g. an end that is distal from its associated acoustic driver). Channel guide 33*a* may correspond to a ramped projection 49 on acoustic pod 3 which may be sized and arranged so as to couple with channel guide 33*a*. Once inserted through channel guide 33*a*, ramped projection 49 may substantially plug the incoming waveguide channel 57, while redirecting the sound waves travelling through waveguide channel 57 upwards towards a sound outlet opening 32. Sound outlet opening 32 may then direct the sound waves generally towards an ear of a user. In other implementations incoming waveguide channel 57 may continue into acoustic pod 3 after coupling and ramped projection 49 may be replaced by a ramped channel within acoustic pod 3 (not shown). In such implementations, sound outlet opening 32 may be disposed on a surface of acoustic pod 3, as opposed to flexible band 1.

A channel guide 33*b* may also comprise an oblong rectangle at an outgoing waveguide channel 57 (e.g. a waveguide channel proximal to its associated acoustic driver). As shown in FIGS. 11A and 11B, channel guide 33*b* may correspond to a projected opening 51 on acoustic pod 3 which may be sized and arranged so as to couple with channel guide 33*b*. Once inserted through channel guide 33*b*, projected opening 51 may extend outgoing waveguide channel 57 so as to connect outgoing waveguide channel 57 with an acoustic driver disposed within acoustic pod 3. Once the outgoing waveguide channel is completed, an acoustic driver (not shown) may produce sound waves intended to travel through waveguide channel 57 to a similar ramped projection 49 and sound outlet opening 32 at an opposite end of flexible waveguide band 1.

Prior to coupling flexible band 1 to acoustic pod 3, the wires extending from electronics opening 35 may be threaded through a corresponding electronics opening 53 on acoustic pod 3. Once the wiring has been properly threaded, flexible band 1 may be coupled to acoustic pod 3 by fastening screws 59 to guide holes 38 and/or by applying a glue or other suitable adhesive between end cap 9 and acoustic pod 3. In other examples, acoustic pod 3 may also include a locking blade (not shown) that may couple with a connecting slot 37, as previously described.

Figure 12A:
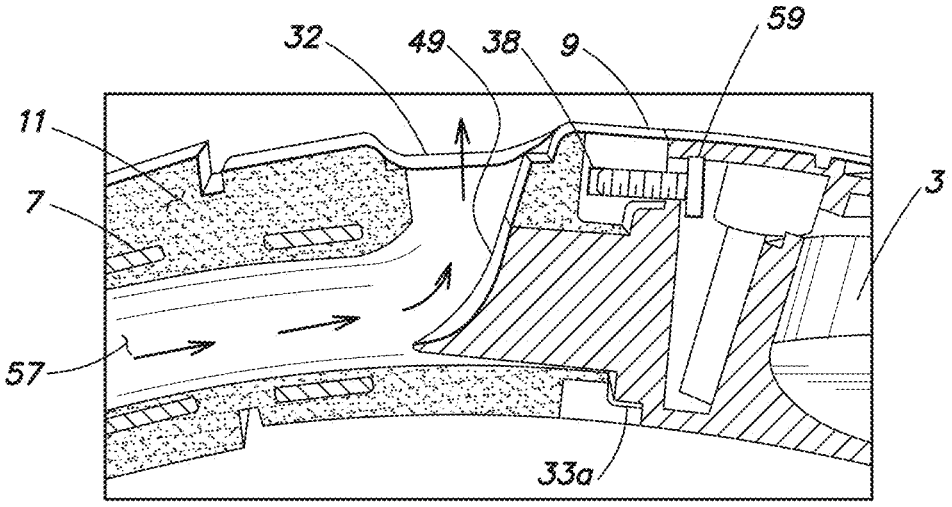
FIG. 12A shows a cross-sectional view of a connection between an acoustic pod and a flexible waveguide band along an incoming waveguide channel according to one implementation of this disclosure.
Figure 12B:
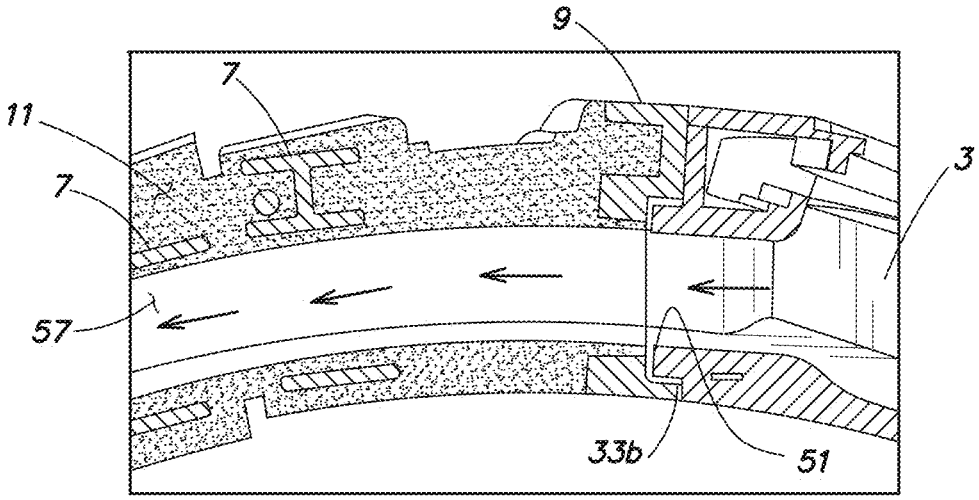
FIG. 12B shows a cross-sectional view of a connection between an acoustic pod and a flexible waveguide band along an outgoing waveguide channel according to one implementation of this disclosure.

FIGS. 12A and 12B show cross-sectional views of the connection between an acoustic pod 3 and a flexible waveguide band 1 along incoming and outgoing waveguide channels 57, respectively, according to one implementation of this disclosure. As shown in FIG. 12A, once acoustic pod 3 has been coupled to flexible band 1, incoming waveguide channel 57 may be plugged by a ramped projection 49, which redirects the incoming sound waves upwards and out through sound outlet opening 32. In other implementations, sound outlet opening 32 may be disposed on a sidewall or lower surface of flexible band 1 and ramped projection 49 may be oriented accordingly so as to redirect the sound waves in any desired direction. It may also be desirable for all or some portion of ramped projection 49 (such as a portion facing nearby acoustic pod 3) to be formed of a material that tends to soundproof incoming waveguide channel 57 from the nearby acoustic driver. Such soundproofing material may avoid unwanted acoustic cross-talk between the outgoing sound waves from the nearby acoustic driver and the incoming sound waves being redirected by ramped projection 49. As shown, for example, in FIG. 12B, once acoustic pod 3 has been coupled to flexible band 1, outgoing waveguide channel 57 may receive sound waves from an acoustic driver disposed in acoustic pod 3 via projected opening 51. Sound waves may then travel through the length of waveguide channel 57 to a similar ramped projection 49 and sound outlet opening 32 at an opposite end of flexible waveguide band 1.

Figure 13:
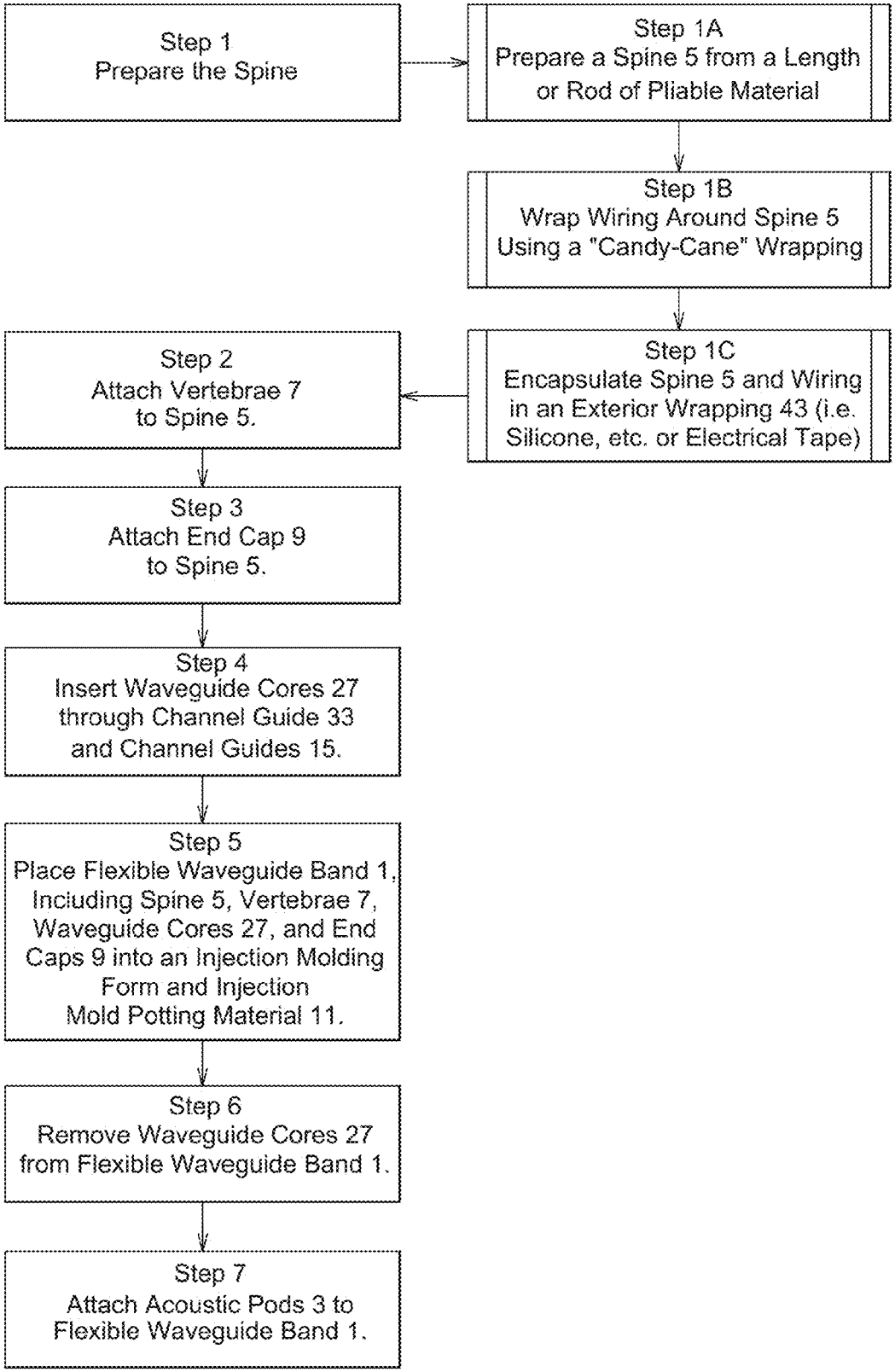
FIG. 13 is a flowchart showing the steps in a manufacturing process for a flexible waveguide band according to one implementation of this disclosure.

FIG. 13 is a flowchart showing steps in an example manufacturing process for a flexible waveguide band according to one implementation of this disclosure. As shown, a first step in a manufacturing process may be to prepare spine 5 (step 1). This may include three steps, such as, preparing a spine 5 from a length or rod of suitably pliable material (step 1A), wrapping wiring around spine 5 using, for example, a "candy-cane" wrapping (step 1B), and encapsulating spine 5 and wiring in an exterior wrapping 43, such as silicone or electrical tape (step 1C). In a second step, one or more vertebrae 7 may be attached to spine 5 (step 2), as described above. In some examples, 25 vertebrae 7 may be attached to spine 5 to prepare a flexible dual-waveguide neckband. In a third step, one or more end caps 9 may be attached to spine 5, as described above (step 3). In some examples, two end caps 9 may be attached to spine 5 at opposite ends of a flexible dual-waveguide neckband. In a fourth step, waveguide cores 27 may be inserted through channel guides 33 on end cap 9 and a series of channel guides 15 on vertebrae 7 (step 4). In a fifth step, the entire flexible waveguide band 1 assembly, including spine 5, vertebrae 7, waveguide cores 27, and end caps 9 may be placed into a molding form and a potting material 11 may be injected or pressed into the mold (step 5). In a sixth step, the flexible waveguide band 1 assembly may be removed from the form and waveguide cores 27 may be removed from the assembly, revealing a waveguide channel (step 6). In some implementations, multiple waveguide cores 27 may be removed, revealing two, three, four or more waveguide channels. Finally, in a seventh step, acoustic pods 3 may be attached to flexible waveguide band 1 (step 7), as previously described.

While the disclosed subject matter is described herein in terms of certain exemplary implementations, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other implementations having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A flexible waveguide band comprising:

a spine;

a plurality of vertebrae, comprising at least one waveguide channel, attached to said spine; wherein said plurality of vertebrae further comprises at least one waveguide channel guide surrounding said at least one waveguide channel; and at least one end cap attached to said spine proximate an end of said spine;

wherein at least a portion of said spine and said plurality of vertebrae are encased within a potting material.

2. The flexible waveguide band according to claim 1 wherein said plurality of vertebrae further comprise two of said waveguide channel guides and said flexible waveguide band includes two of said waveguide channels.

3. The flexible waveguide band according to claim 2 wherein said flexible waveguide band further comprises at least two acoustic pods disposed proximate opposite ends of said flexible waveguide band.

4. The flexible waveguide band according to claim 3 wherein said two acoustic pods each comprise at least one acoustic driver, and wherein said acoustic drivers radiate sound waves into said waveguide channels.

5. The flexible waveguide band according to claim 1 wherein said flexible waveguide band comprises a neckband.

6. The flexible waveguide band according to claim 1 wherein said flexible waveguide is formed into a generally semi-circular shape.

7. The flexible waveguide band according to claim 6 wherein the shape of said flexible waveguide band may be adjusted by a user through bending and said flexible waveguide band will substantially retain the adjusted shape.

8. The flexible waveguide band according to claim 1 wherein said plurality of vertebrae further comprise a spacer.

9. The flexible waveguide band according to claim 3 wherein at least one of said two acoustic pods includes a ramped projection for coupling with said at least one end cap.

10. The flexible waveguide band according to claim 2 wherein said waveguide channel guides include a plurality of projections for receiving at least two removable waveguide cores.

11. The flexible waveguide band according to claim 1 wherein said plurality of vertebrae include projections for spacing said vertebrae within said potting material.

12. The flexible waveguide band according to claim 1 wherein said spine further comprises a metal rod or wire and electrical wiring.

13. The flexible waveguide band according to claim 12, wherein said electrical wiring is wrapped around said metal rod or wire.

14. A method of assembling a flexible waveguide band comprising:

attaching a plurality of vertebrae, each with at least one waveguide channel guide, along the length of a spine;

inserting at least one waveguide core within said waveguide channel guide;

molding said spine, said plurality of vertebrae, and said at least one waveguide core in a potting material; and removing said at least one waveguide core from the waveguide channel.

15. The method of claim 14 wherein said plurality of vertebrae have two waveguide channel guides and wherein two waveguide channels are defined within the waveguide channel guides by the removal of said at least one waveguide core.

16. The method of claim 14, wherein the step of molding said spine, said plurality of vertebrae, and said at least one waveguide core in a potting material further comprises disposing said spine, said plurality of vertebrae, and said at least one waveguide core in a semi-circular mold and injecting said potting material into said mold.

17. The method of claim 14, further comprising the step of attaching at least two end caps proximate the ends of said spine.

18. The method of claim 17, further comprising attaching acoustic pods to said end caps.

19. A flexible waveguide band made by the method of claim 14.

20. A flexible dual-waveguide band comprising:

a spine comprising a pliable rod;

a plurality of vertebrae, each having two waveguide channel guides and a center portion, attached to said spine, wherein said center portion comprises an open portion for receiving said spine;

two end caps attached to said spine at opposite ends of said spine, wherein said end caps comprise two waveguide channel guides, a center portion, and an electronics opening, and wherein said center portion comprises an open portion for receiving said spine; and potting material encasing said spine, said plurality of vertebrae, and said end caps.

* * * * *